US007461688B2

(12) United States Patent
Huang et al.

(10) Patent No.: US 7,461,688 B2
(45) Date of Patent: Dec. 9, 2008

(54) HEAT TRANSFER DEVICE

(75) Inventors: Bin-Juine Huang, Taipei (TW); Chern-Shi Lam, Taipei County (TW); Chih-Hung Wang, Taipei County (TW); Huan-Hsiang Huang, Taipei County (TW); Yu-Yuan Yen, Taichung County (TW)

(73) Assignee: Advanced Thermal Device Inc., Taipei (TW)

( * ) Notice: Subject to any disclaimer, the term of this patent is extended or adjusted under 35 U.S.C. 154(b) by 358 days.

(21) Appl. No.: 10/710,663

(22) Filed: Jul. 27, 2004

(65) Prior Publication Data

US 2005/0082033 A1 Apr. 21, 2005

(30) Foreign Application Priority Data

Oct. 20, 2003 (TW) ..... 92128972 A

(51) Int. Cl.
*F28D 15/00* (2006.01)
*H05K 7/20* (2006.01)

(52) U.S. Cl. ..... 165/104.21; 165/104.26

(58) Field of Classification Search ..... 165/104.21, 165/104.26, 104.33, 80.4; 361/700; 29/890.032, 29/890.036, 890.037; 122/366
See application file for complete search history.

(56) References Cited

U.S. PATENT DOCUMENTS

| | | | | |
|---|---|---|---|---|
| 3,387,653 | A * | 6/1968 | Coe | 165/165 |
| 4,765,396 | A | 8/1988 | Seidenberg | 165/104.26 |
| 4,899,810 | A * | 2/1990 | Fredley | 165/41 |
| 4,903,761 | A * | 2/1990 | Cima | 165/104.25 |
| 5,303,768 | A * | 4/1994 | Alario et al. | 165/104.26 |
| 5,944,092 | A * | 8/1999 | Van Oost | 165/104.26 |
| 6,058,711 | A * | 5/2000 | Maciaszek et al. | 62/3.2 |
| 6,330,907 | B1 * | 12/2001 | Ogushi et al. | 165/104.26 |
| 6,382,309 | B1 * | 5/2002 | Kroliczek et al. | 165/104.26 |
| 6,450,132 | B1 * | 9/2002 | Yao et al. | 122/366 |
| 2002/0007937 | A1 * | 1/2002 | Kroliczek et al. | 165/104.26 |
| 2003/0178184 | A1 * | 9/2003 | Kroliczek et al. | 165/104.26 |

FOREIGN PATENT DOCUMENTS

| | | |
|---|---|---|
| JP | 54-120755 | 2/1978 |
| JP | 60002892 | 1/1985 |
| JP | 60-235992 | 11/1985 |
| JP | 61-139377 | 8/1986 |
| JP | 62-49191 | 3/1987 |
| JP | 62-79655 | 4/1987 |
| JP | 2001-012652 | 1/2001 |
| JP | 2001-108154 | 4/2001 |
| JP | 2003-279277 | 10/2003 |

* cited by examiner

*Primary Examiner*—Tho V Duong
(74) *Attorney, Agent, or Firm*—Jianq Chyun IP Office

(57) ABSTRACT

The heat transfer device at least comprises: an evaporator, a heat conductor and a connecting pipe. The evaporator comprises: a first hollow tube; a porous core mortised inside the first hollow tube; and a second hollow tube mortised on the first hollow tube. The heat conductor 220 covers the evaporator. The heat conductor is on the heating device. The connecting pipe is connected to first and second hollow tubes. The connecting pipe is used for containing a working fluid. The condenser is on the connecting pipe. The porous core, the first and second hollow tube, and the heat conductor are mortised together so as to simplify the manufacturing process, and reduce the cost. Further, the evaporator is tightly covered and fixed by the heat conductor so that the heat generated by the heating device can be uniformly conducted to the evaporator to enhance the heat conductivity.

7 Claims, 8 Drawing Sheets

HEAT TRANSFER DEVICE

CROSS REFERENCE TO RELATED APPLICATIONS

This application claims the priority benefit of Taiwan application serial no. 92128972, filed Oct. 20, 2003.

BACKGROUND OF INVENTION

1. Field of the Invention

This invention generally relates to a heat transfer device and manufacturing method thereof, and more particularly to a heat transfer device and manufacturing method thereof to simplify the manufacturing process, reduce costs, and enhance heat conductivity.

2. Description of Related Art

To fast dissipate the heat generated from operation of the electronic devices, conventionally a radiator will be disposed on the heating element of the electronic device provide a larger area for heat dissipation. Further, a cooling fan will be used to provide a cool air current to further dissipate the heat. Hence, the electronic device can keep within the range of the operational temperature. For example, the radiator and the cooling fan are used in the CPU, North Bridge, and graphic chip of the personal computer, which can generate high heat.

It should be noted that recently a heat transfer device is developed by using transformation between liquid state and gaseous state. This heat transfer device has the advantages of high conductance (30-6000 W), long distance (0.3-10 m) and single directional transferability, and flexibility, and is not affected by the gravity. Hence, it gradually replaces the conventional radiator.

FIG. 1 is a conventional heat transfer device. Referring to FIG. 1, the conventional heat transfer device 100 comprises a evaporator 110, a loop heat pipe 120, and a condenser 130. The evaporator 110 comprises a metal tube 112 and a porous core 114. The porous core 114 is disposed inside the metal tube 112. The evaporator 110 is disposed on the heating device such as CPU. The loop heat pipe 120 is connected to the evaporator 110 and has a proper amount of working fluid therein. The condenser 130 is disposed on the loop heat pipe 120 to condense the steam in the loop heat pipe to the liquid state.

When the heating device generates high heat, the evaporator 110 will receives the heat and thus the working fluid in the porous core 114 will be heated up and enter into the loop heat pipe 120 and the condenser 130. The condenser 130 then condenses the steam in the loop heat pipe to the liquid state. The capillarity attraction of the porous core 114 will attract the working fluid in the loop heat pipe 120 back to the evaporator 110 and the porous core 114 therein. Hence, this design form a loop so that the working fluid can flow circularly in the loop heat pipe 120 and transfer the heat generated by the heating device to the condenser 130.

FIGS. 2A-2C show the manufacturing process of the conventional heat transfer device. Referring to the FIGS. 2A-2C, the manufacturing method of the conventional heat transfer device 100 directly fuses a porous core 114 inside a hollow metal tube 112 (as shown in FIG. 2A). Then the two caps 140 are welded at the two ends of the hollow metal tube 112 (as shown in FIG. 2B). Then the loop heat pipe 120 is welded on the caps 140. A heat conducting platform 150 is welded at the bottom if the hollow metal tube 112 so that the high heat of the heating device 10 can be transferred from the heat conducting platform 150 to the evaporator 110 (as shown in FIG. 2C). It should be noted that the manufacturing method of the conventional heat transfer device has the following disadvantages:

1. The porous core is directly fused inside the hollow metal tube, which is costly and very difficult to implement and to control the quality.

2. Two caps, the loop heat pipe, and the heat conducting platform are fixed by welding, which is difficult to implement because there several welding points. Further, the porous core is easy to be damaged during the welding process.

3. The heat conducting platform can only conduct the heat to the lower part of the evaporator. Hence the heat conductance is too low.

Further, there is another manufacturing method for the conventional heat transfer device. This method is very similar to the first conventional method. The difference is that the porous core is fused by using the module and is embedded into the hollow metal tube by thermal connecting technology. However, this method also has the above disadvantages. Further, because the end of the porous core providing the working fluid is difficult to be tightly connected to the hollow metal tube by thermal connecting technology, the working fluid is easy to leak.

SUMMARY OF INVENTION

An object of the present invention is to provide a heat transfer device to transfer the heat out of the heating device in order to effectively dissipate the heat. The heat transfer device is easy to manufacture with low cost.

Another object of the present invention is to provide a method for manufacturing a heat transfer device. The elements of the heat transfer device can be assembled by mortising each other to simplify the manufacturing process, reduce the cost, and enhance the heat conductivity.

The present invention provides a heat transfer device for transferring a heating source from a heating device, the heat transfer device at least comprising: an evaporator, the evaporator comprising: a first hollow tube; a porous core mortised inside the first hollow tube; a second hollow tube mortised on the first hollow tube; a heat conductor covering the evaporator, the heat conductor being on the heating device; a connecting pipe connected to the evaporator, the connecting pipe being used for containing a working fluid; and a condenser on the connecting pipe.

In a preferred embodiment of the present invention, the heat conductor comprises a first heat conducting block having a heat conducting tenon; and a second heat conducting block having a mortise corresponding to the tenon, the heat conducting tenon being inserted into the mortise so that the first and second heat conducting blocks cover the evaporator. The height of the tenon is smaller than the depth of the mortise to enhance the tightness between the tenon and the mortise so that the first and second heat conducting blocks can contact closely the outer wall of the evaporator to obtain good heat conductivity.

In a preferred embodiment of the present invention, the porous core has a fluid channel therein, the fluid channel being connected to a fluid reservoir. A vapor channel is between the first hollow tube and the porous core, and the vapor channel is connected to the connecting pipe.

In a preferred embodiment of the present invention, the first hollow tube has a closed end; the closed end has a first surface; the first surface has a first hole; the connecting pipe has an end connected to the first hole to connect the first hollow tube. The second hollow tube has a closed end; the closed end has a second surface; the second surface has a second hole; the connecting pipe has an end connected to the second hole to connect the second hollow tube.

The present invention provides a method for manufacturing a heat transfer device, comprising: mortising a porous core into a first hollow tube; mortising a second hollow tube on the first hollow tube; covering a heat conductor on the first hollow tube; and connecting a connecting pipe to the first hollow tube and the second hollow tube.

In a preferred embodiment of the present invention, the heat conductor includes a first heat conducting block and a second heat conducting block, and the first heat conducting block and the second heat conducting block are mortised together to cover the first hollow tube.

In a preferred embodiment of the present invention, the first hollow tube has a closed end; the closed end has a first surface; before the step of mortising the porous core into the first hollow tube, the method further comprises hole-punching to form a first hole. The second hollow tube has a closed end, and the closed end has a second surface; before the step of mortising the porous core into the second hollow tube, the method further comprises hole-punching to form a second hole. It further comprises hole-widening at an opposite end of the second hollow tube at the same time of performing the step of hole-punching to form the second hole, in order to facilitate mortising the second hollow tube to the first hollow tube.

In a preferred embodiment of the present invention, the connecting pipe and the first hollow tube are connected by mortising an end of the connecting pipe to the first hole and welding; the connecting pipe and the second hollow tube are connected by mortising an end of the connecting pipe to the second hole and welding.

In a preferred embodiment of the present invention, it further uses a press module having a sealing function to press an area where the first hollow tube and the first hollow tube are mortised together, so that the mortised area will be deformed and the first hollow tube and the second hollow tube can contact tightly the porous core to prevent the working fluid from leakage into the vapor channel.

In a preferred embodiment of the present invention, it further disposes a condenser on the connecting pipe after the step of connecting the connecting pipe to the first hollow tube and the second hollow tube.

The elements of the heat transfer device (such as the porous core, the first and second hollow tube, and the heat conductor) of the present invention are mortised together so as to simplify the manufacturing process, reduce the cost and enhance the heat conductivity.

The above is a brief description of some deficiencies in the prior art and advantages of the present invention.

Other features, advantages and embodiments of the invention will be apparent to those skilled in the art from the following description, accompanying drawings and appended claims.

DETAILED DESCRIPTION

Figure 1:
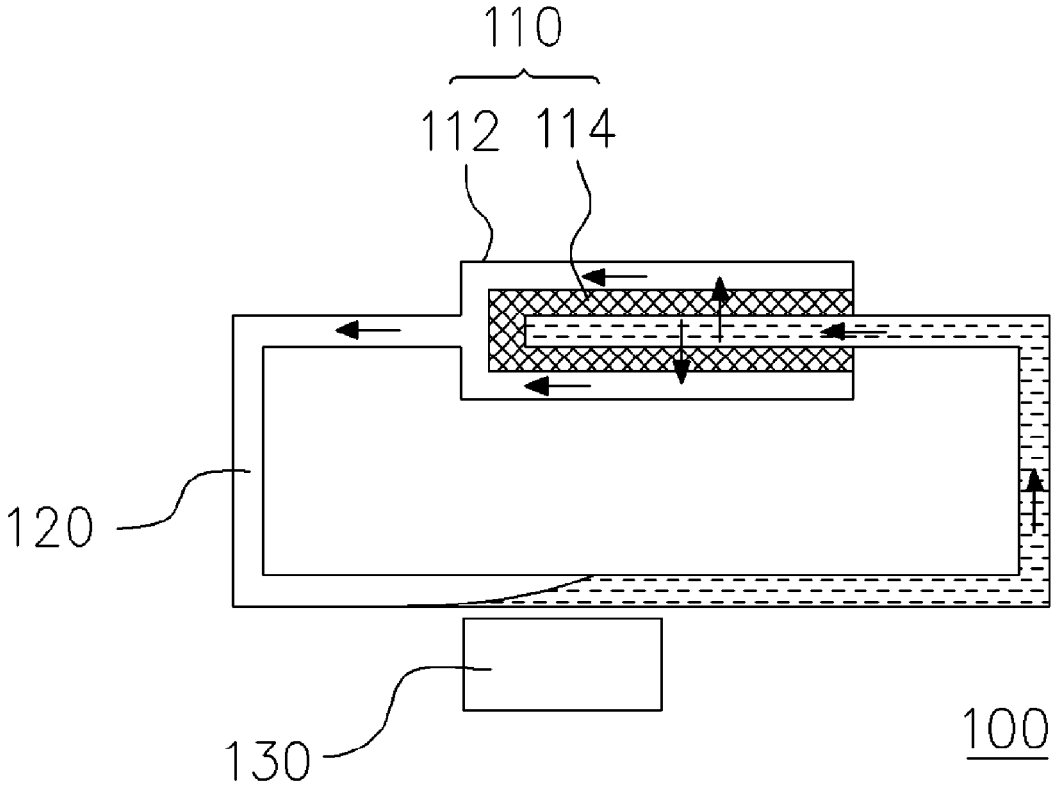
FIG. 1 (PRIOR ART)
FIG. 1 is a conventional heat transfer device.
Figure 2A:
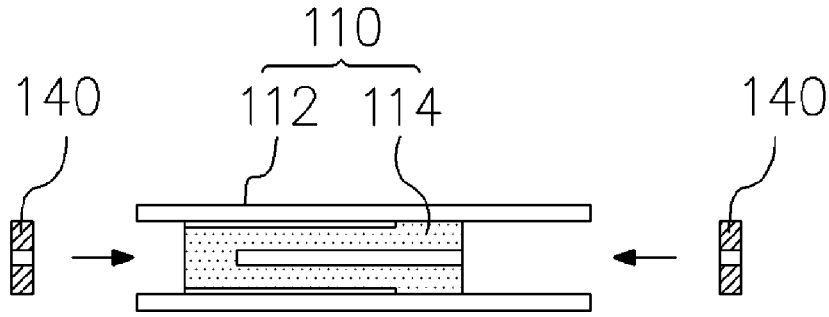
FIG. 2A (PRIOR ART)
FIGS. 2A-2C show the manufacturing process of the conventional heat transfer device.
Figure 2B:
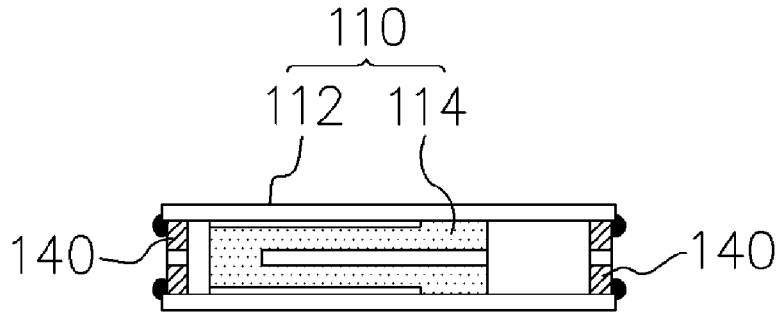
FIG. 2B (PRIOR ART)
Figure 2C:
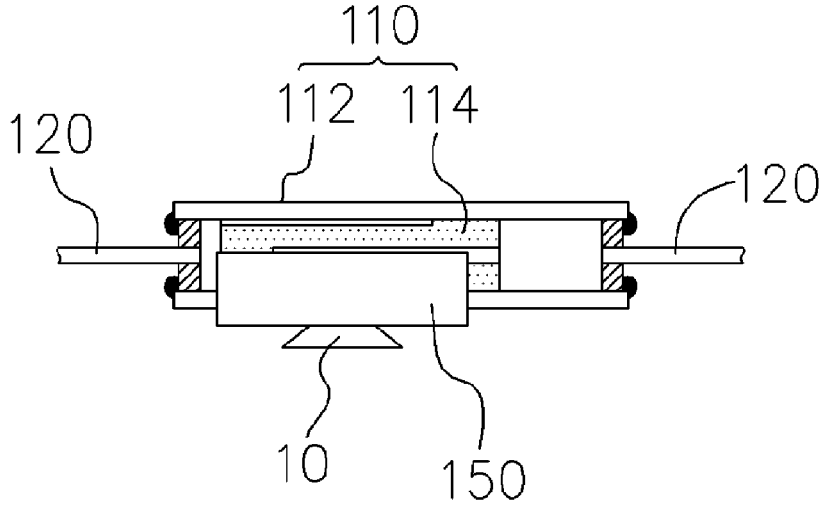
FIG. 2C (PRIOR ART)
Figure 3:
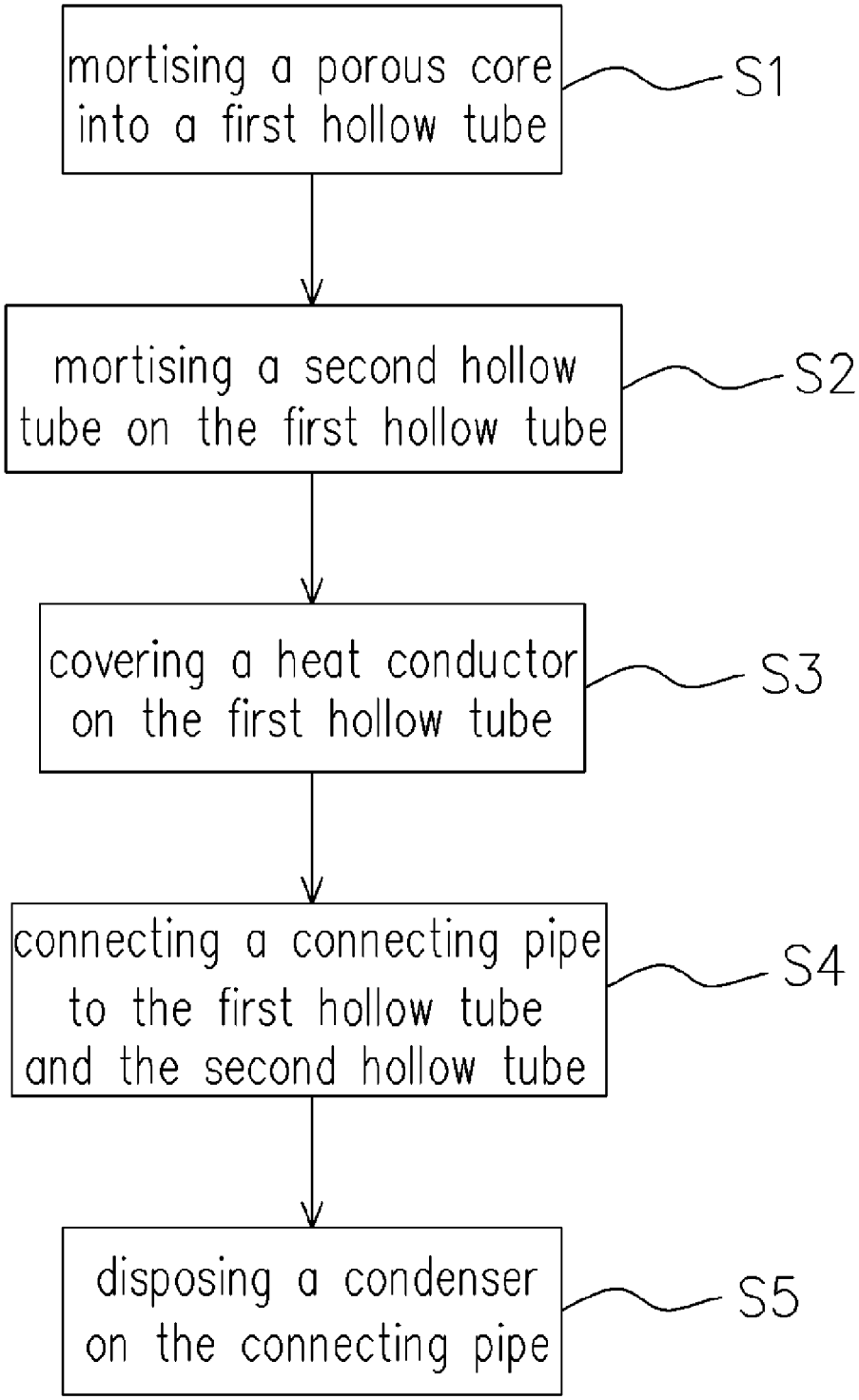
FIG. 3 is a manufacturing process of the heat transfer device in accordance with a preferred embodiment of the present invention.

FIG. 3 is a manufacturing process of the heat transfer device in accordance with a preferred embodiment of the present invention. The manufacturing process includes: mortising a porous core into a first hollow tube (S1); mortising a second hollow tube on the first hollow tube (S2); covering a heat conductor on the first hollow tube (S3); connecting a connecting pipe to the first hollow tube and the second hollow tube (S4); and disposing a condenser on the connecting pipe (S5). The detailed manufacturing process will be illustrated as follows.

Figure 4A:
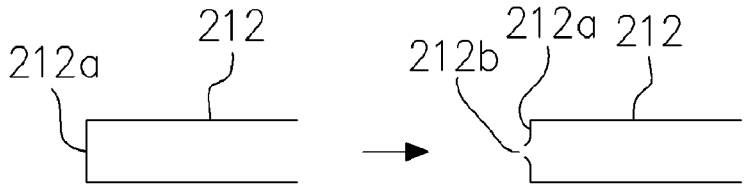
FIGS. 4A-4F show a detailed manufacturing process of the heat transfer device in accordance with a preferred embodiment of the present invention.

FIGS. 4A-4F show a detailed manufacturing process of the heat transfer device in accordance with a preferred embodiment of the present invention. Referring to FIG. 4A, a first hollow tube 212 is provided. The first hollow tube 212 in this embodiment is a hollow tube with a closed end. The closed end of the first hollow tube 212 has a first surface 212*a* . A hole-punching is performed to form a first hole 212*b*.

Figure 4B:
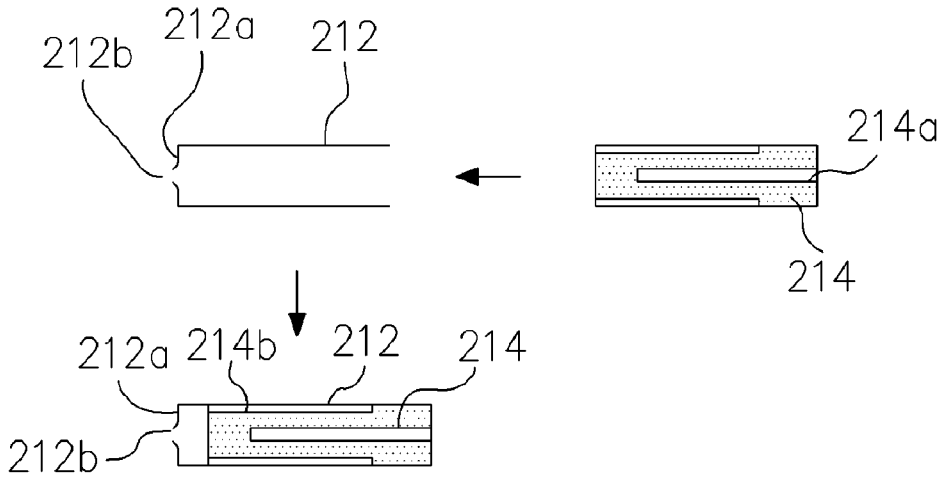

Referring to FIG. 4B, the porous core 214 is mortised into the first hollow tube 212. The porous core 214 has a fluid channel 214*a* therein for injecting a working fluid therein. The outer surface of the porous core 214 for example has one or more trenches so that after the porous core 214 is mortised to the first hollow tube 212 the one or more trenches can form one or more vapor channels 214*b* with the inner surface of the first hollow tube 212.

Figure 4C:
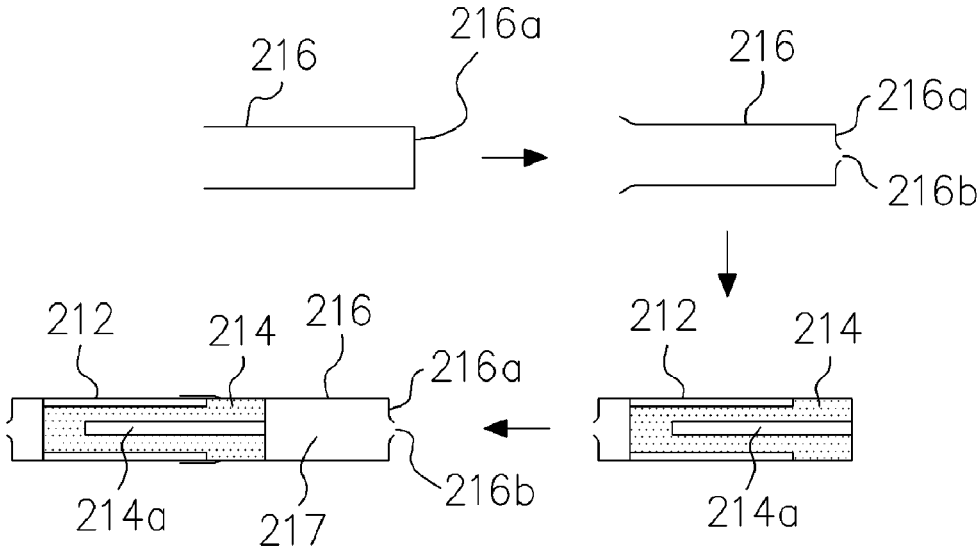

Referring to FIG. 4C, a second hollow tube 216 is provided. The second hollow tube 216 in this embodiment is a hollow tube with a closed end. The closed end of the second hollow tube 216 has a second surface 216*a* . A hole-punching is performed to form a second hole 216*b*. Further, a hole-widening step can be performed at the opposite end of the second hollow tube 216 to facilitate mortising the second hollow tube 216 to the first hollow tube 212.

Figure 4D:
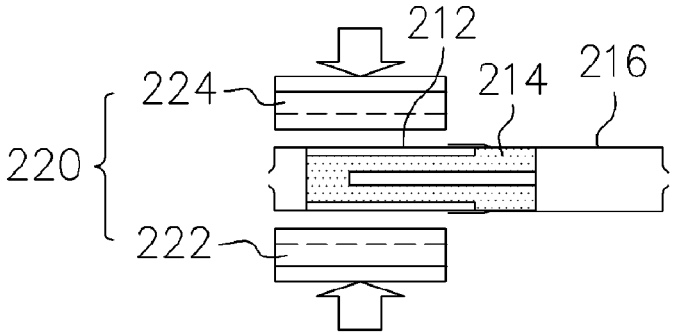

Referring to FIG. 4D, a heat conductor 220 is covered on the first hollow tube 212 to form an evaporator 210. In this embodiment, the heat conductor 220 includes a first heat conducting block 222 and a second heat conducting block 224. The evaporator 210 is covered by mortising the first heat conducting block 222 and the second heat conducting block 224.

Figure 4E:
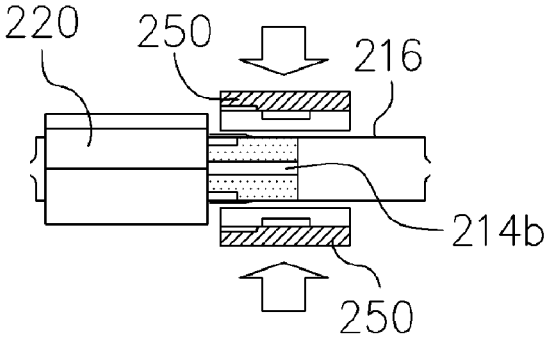

Referring to FIG. 4E, a press module 250 with a sealing function is used to press the mortised area where the second hollow tube 216 and the porous core 214 are mortised, so that the mortised area is deformed and the second hollow tube 216 can tightly contact the porous core 214 to prevent the working fluid from directly flowing into the vapor channel 214*b* . Hence, there is no concern of internal leakage inside the evaporator.

Figure 4F:
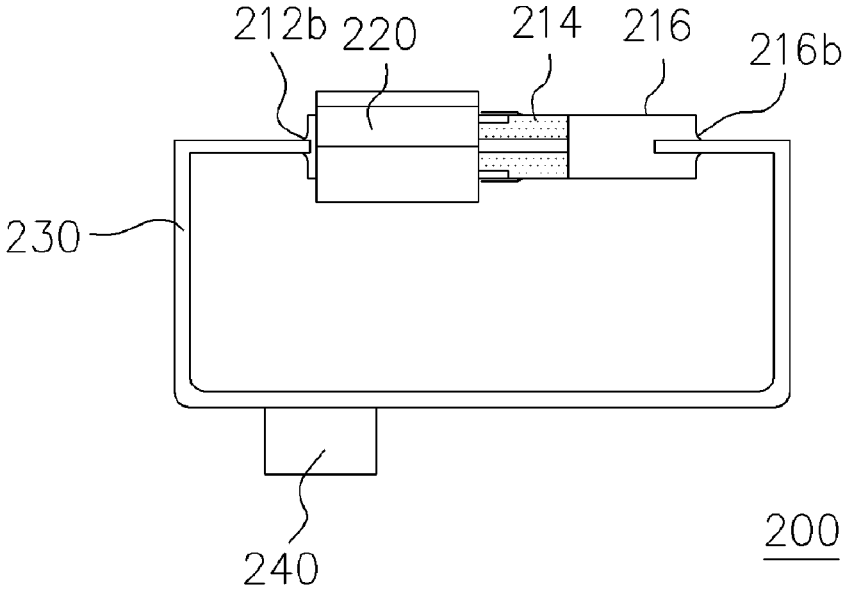

Referring to FIG. 4F, a connecting pipe 230 is connected to the first hollow tube 212 and the second hollow tube 216. The connecting pipe 230 and the first hollow tube 212 are connected by mortising an end of the connecting pipe 230 to the first hole 212*b* and welding; the connecting pipe 230 and the second hollow tube 216 are connected by mortising an end of the connecting pipe 230 to the second hole 216*b* and welding.

Finally, a condenser 240 is disposed on the connecting pipe 230 to form the heat transfer device 200 of the present invention.

In light of the above, because the porous core is mortised into the first hollow tube, then the second hollow tube is mortised on the first hollow tube, the porous core is fixed by tightening up the first hollow tube, the second hollow tube, and the porous core. Hence, the present invention does not require the fusing or fusing and thermal connecting technology like the conventional manufacturing methods. Therefore, the present invention can simplify the manufacturing process and reduce the cost. Further, the first and second hollow tubes of the present invention use a thinner metal shell. By pressing an area where the first hollow tube and the first hollow tube are mortised together, the mortised area will be deformed and the first hollow tube and the second hollow tube can contact tightly the porous core to prevent the working fluid from leakage into the vapor channel. Further, the first and second hollow tubes of the present invention are closed ended tube, a cap is not required to be welded to the closed end (the welding step is required only at the connection to the connecting pipe). Hence, the present invention can reduce the number of the welding steps to prevent the porous core from damaged due to the welding step.

Figure 5:
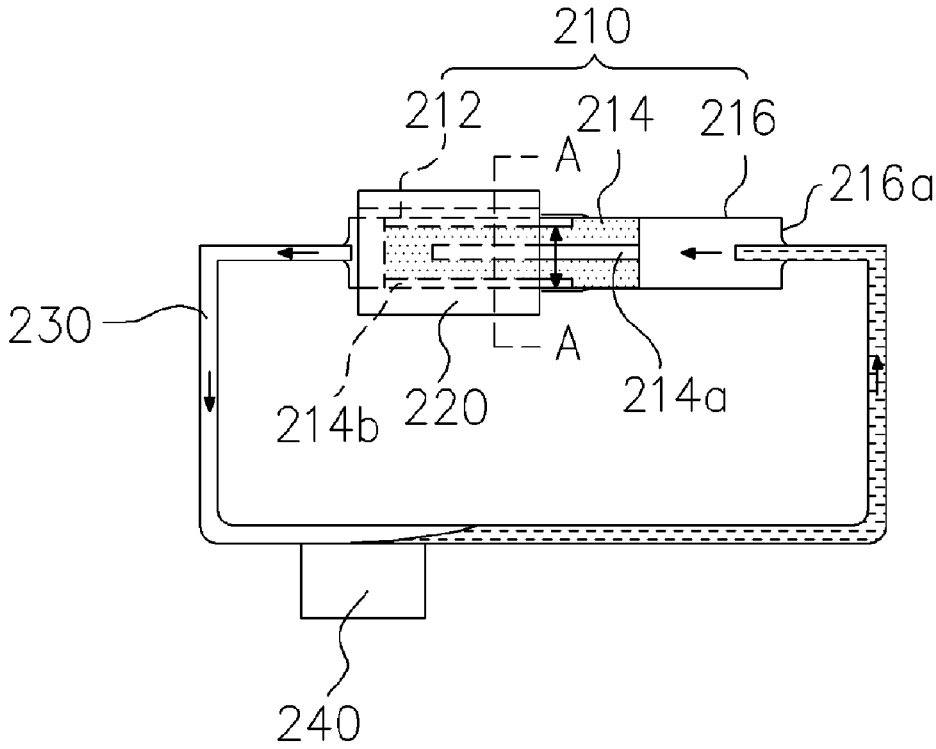
FIG. 5 is the structure of the heat transfer device in accordance with a preferred embodiment of the present invention.
Figure 6:
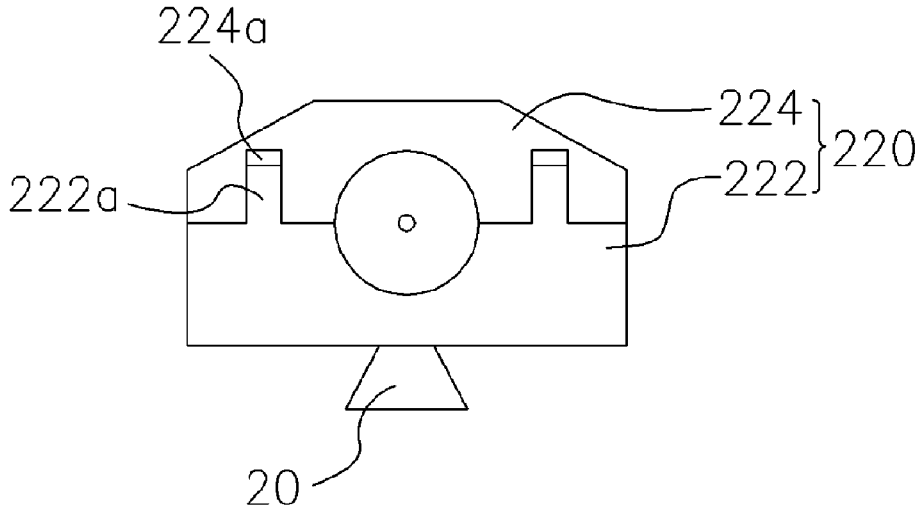
FIG. 6 is a cross-sectional view of FIG. 5 along the A-A line.

FIG. 5 is the structure of the heat transfer device in accordance with a preferred embodiment of the present invention. FIG. 6 is a cross-sectional view of FIG. 5 along the A-A line. Referring to FIGS. 5 and 6, the heat transfer device 200 is configured for transferring a heating source from a heating device 20. The heat transfer device 200 at least comprises: an evaporator 210, a heat conductor 220 and a connecting pipe 230. The evaporator 210 comprises: a first hollow tube 212; a porous core 214 mortised inside the first hollow tube 212; a second hollow tube 216 mortised on the first hollow tube 212. The first hollow tube 212 and the second hollow tube 216 are connected and secured as a whole by a connection between an end of the first hollow tube 212 and an end of the second hollow tube 216 that are mortised one to another.

The heat conductor 220 covers the evaporator 210. The heat conductor 220 is on the heating device 20. The connecting pipe 230 is connected to first and second hollow tubes 212 and 216. The connecting pipe 230 is used for containing a working fluid. Further, the porous core 214 has a fluid channel 214*a* therein. The fluid channel 214*a* is connected to the fluid reservoir 217. The fluid reservoir 217 is a space inside the second hollow tube 216. There is at least a vapor channel 214*b* between the first hollow tube 212 and the porous core 214. The vapor channel 214*b* is connected to the connecting pipe 230. Further a condenser 240 is disposed on the connecting pipe 230.

When the heating device 20 generates high heat, the working fluid in the porous core 214 will be heated up and becomes vapor. The capillarity attraction of the porous core 214 will attract the working fluid in the connecting pipe 230 back to the fluid channel 214*a* of the porous core 214. The vapor will go to the connecting pipe 230 via the vapor channel 214*b* . Further, the vapor entering into the condenser 240 will be condensed to the liquid state and goes back to the evaporator 210. Hence, the working fluid can circularly flow through the connecting pipe 230 (along the direction of the arrow as shown in FIG.5) by converting the working fluid between the gaseous state and the liquid state, so that the heat generated by the heating device 20 can be transferred out of the heating device 20.

Referring to FIG. 6, in a preferred embodiment of the present invention, the heat conductor 220 comprises a first heat conducting block 222 having a heat conducting tenon 222*a*; and a second heat conducting block 224 having a mortise 224*a* corresponding to the heat conducting tenon 222*a*. The heat conducting tenon 222*a* is inserted into the mortise 224*a* so that the first and second heat conducting blocks 222 and 224 can cover the evaporator 210. Hence, the high heat generated by the heating device 20 can be uniformly conducted to the evaporator 210 via the heat conductor 220. Further, the height of the tenon 222*a* is smaller than the depth of the mortise 224*a* to enhance the tightness between the tenon 222*a* and the mortise 224*a* so that the first and second heat conducting blocks 222 and 224 can contact closely the outer wall of the evaporator 210 to obtain good heat conductivity.

In the above embodiment, the heat conductor 220 comprises a first heat conducting block 222 and a second heat conducting block 224 to cover the evaporator 210. However, one skilled in the art should know that the heat conductor present invention is not limited to two heat conducting blocks. It can be mortised by several heat conducting blocks. Further, it is not limited to one evaporator covered by the heat conducting blocks. The heat conducting blocks also can cover several evaporators. In addition, the shape of the heat conducting blocks can be any shape so long as the heat conducting blocks can cover the evaporator after assembly. An example of the heat conductor will be illustrated as follows.

Figure 7A:
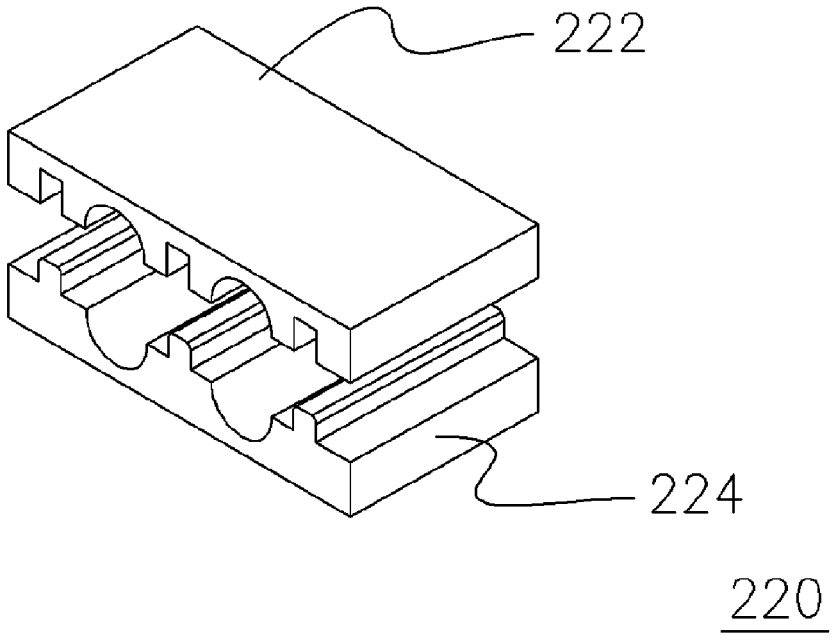
FIGS. 7A-7D show the structure of the heat conductor device in accordance with another preferred embodiment of the present invention.
Figure 7B:
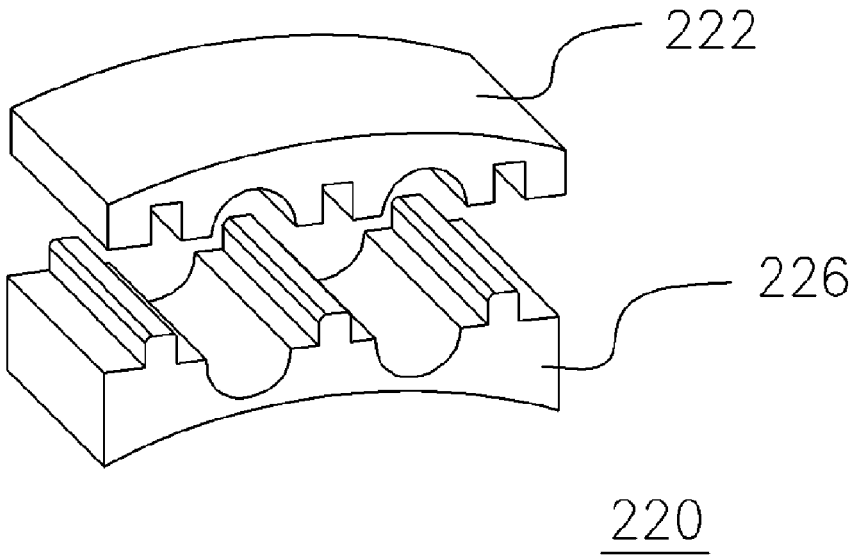
Figure 7C:
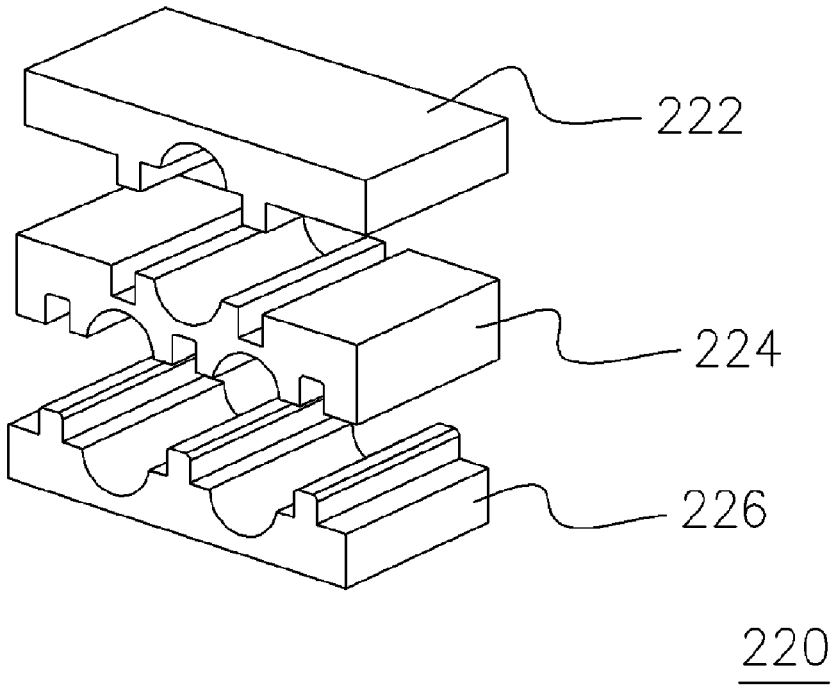
Figure 7D:
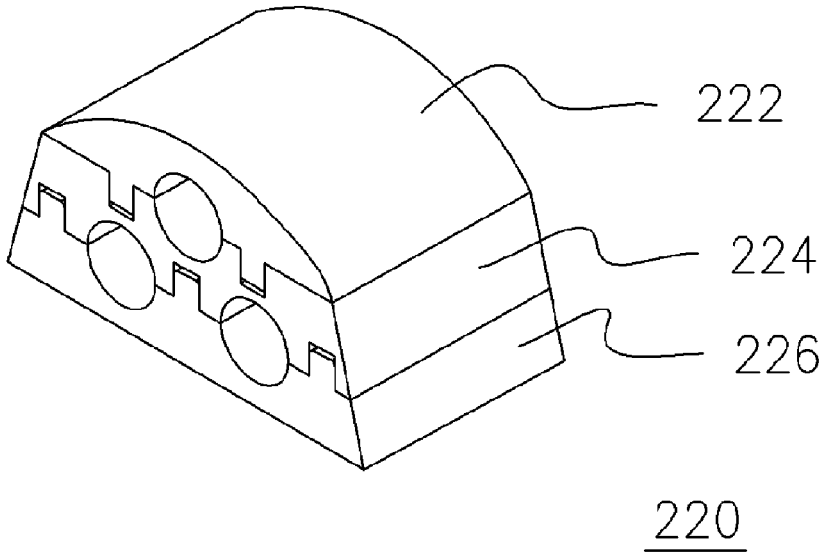

FIGS. 7A-7D show the structure of the heat conductor device in accordance with another preferred embodiment of the present invention. Referring to FIGS. 7A and 7B, the heat conductor 220 includes two heat conducting blocks (first heat conducting block 222 and second heat conducting block 224) and covers two evaporators (not shown). Referring to FIGS. 7C and 7D, the heat conductor 220 includes three heat conducting blocks (first heat conducting block 222, second heat conducting block 224, and third heat conducting block 226) and covers two evaporators (not shown). Further, each of the above evaporators can be connected to an independent connecting pipe, or all evaporators can be connected to a single connecting pipe.

In brief, the elements of the heat transfer device of the present invention (the porous core, the first and second hollow tube, and the heat conductor) are mortised together so as to simplify the manufacturing process, and reduce the cost. Further, the evaporator is tightly covered and fixed by the heat conductor so that the heat generated by the heating device can be uniformly conducted to the evaporator to enhance the heat conductivity.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

The invention claimed is:

1. A heat transfer device for transferring a heating source from a heating device, said heat transfer device comprising:

an evaporator, said evaporator comprising:

a first hollow tube having a first open end and a first closed end opposite to said first open end;

a porous core mortised inside said first hollow tube and having a first end and a second end opposite to said first end, wherein the porous core has a fluid channel surrounded by and located inside the porous core and extending along a direction from said first end to said second end, and said fluid channel is open at said first end and is close at said second end;

a second hollow tube having a second open end and a second closed end opposite to said second open end, wherein a part of said first hollow tube is mortised and secured inside said second hollow tube, the other part of said first hollow tube is exposed outside said second hollow tube, said first open end is mortised and secured inside said second open end, a direction from said first closed end to said first open end is opposite to another direction from said second closed end to said second open end, said porous core is located between said first closed end and said second closed end said second hollow tube has a fluid reservoir therein, and said fluid reservoir is located within said second hollow tube and beside said first end of said porous core and communicates with said fluid channel through an opening at said first end;

a connecting pipe connected to said evaporator, said connecting pipe being used for containing a working fluid; and a condenser on said connecting pipe.

2. The device of claim 1, further comprising a heat conductor covering said evaporator, wherein said heat conductor is on said heating device.

3. The device of claim 2, wherein said heat conductor comprises:

a first heat conducting block having a heat conducting tenon; and a second heat conducting block having a mortise corresponding to said tenon, said heat conducting tenon being inserted into said mortise so that said first and second heat conducting blocks cover said evaporator.

4. The device of claim 3, wherein the height of said tenon is smaller than the depth of said mortise.

5. The device of claim 1, further comprising a vapor channel between said first hollow tube and said porous core, said vapor channel being connected to said connecting pipe.

6. The device of claim 1, wherein said first hollow tube has a closed end, said closed end having a first surface, said first surface having a first hole, said connecting pipe having an end connected to said first hole to connect said first hollow tube.

7. The device of claim 1, said second closed end having a second surface, said second surface having a second hole, said connecting pipe having an end connected to said second hole to connect said second hollow tube.

* * * * *